US006343552B1

(12) United States Patent
Harris

(10) Patent No.: US 6,343,552 B1
(45) Date of Patent: Feb. 5, 2002

(54) SOLVENT APPLICATION SYSTEM

(75) Inventor: Marlon D. Harris, Christiansburg, VA (US)

(73) Assignee: Alliant Techsystems Inc., Edina, MN (US)

( * ) Notice: Subject to any disclaimer, the term of this patent is extended or adjusted under 35 U.S.C. 154(b) by 53 days.

(21) Appl. No.: 09/587,773

(22) Filed: Jun. 6, 2000

(51) Int. Cl.[7] ..... F42B 3/00; F42B 5/18; F42B 33/14

(52) U.S. Cl. ..... 102/282; 102/430; 102/431; 102/530; 102/700; 86/1.1; 86/12; 86/17; 86/20.12; 86/47

(58) Field of Search ..... 102/430, 431, 102/530, 282, 700; 86/20.12, 12, 17, 47, 1.1

(56) References Cited

U.S. PATENT DOCUMENTS

| | | | | | |
|---|---|---|---|---|---|
| 3,051,086 | A | * | 8/1962 | La Costa et al. | 102/282 X |
| 4,689,185 | A | * | 8/1987 | Lopata et al. | 86/17 X |
| 4,702,167 | A | | 10/1987 | Reinelt et al. | 102/282 |
| 4,864,932 | A | | 9/1989 | Reinelt et al. | 102/282 |
| 5,052,304 | A | * | 10/1991 | Rahnenfuhrer et al. | 102/431 X |
| 5,212,342 | A | | 5/1993 | Eches et al. | 102/317 |
| 5,277,118 | A | * | 1/1994 | Conil | 102/430 X |
| 5,282,423 | A | | 2/1994 | Sikorski et al. | 102/431 |
| 5,454,323 | A | | 10/1995 | Conil | 102/282 |
| 5,563,365 | A | * | 10/1996 | Dineen et al. | 102/430 X |
| 5,672,842 | A | | 9/1997 | Brion et al. | 102/282 |
| 5,747,723 | A | | 5/1998 | Buckalew et al. | 102/282 |
| 5,844,163 | A | | 12/1998 | Lindskog | 89/46 |

FOREIGN PATENT DOCUMENTS

| | | | | |
|---|---|---|---|---|
| EP | 475207 | * | 8/1990 | 102/431 |
| JP | 5-118793 | * | 5/1993 | 102/430 |

* cited by examiner

*Primary Examiner*—Peter A. Nelson
(74) *Attorney, Agent, or Firm*—Nikolai & Mersereau, P.A.

(57) ABSTRACT

A system and method for use in providing a peripheral seal between the case and lid of a MACS modular unit or other workpiece interface, the system including a workpiece holding device for carrying and moving a workpiece of interest in relation to a solvent dispensing system and a solvent dispensing system for dispensing a metered amount of solvent into the interface to be sealed on the workpiece, the solvent dispensing system further including a metering device for dispensing a predetermined known amount of the solvent, a stationary dispensing valve for dispensing solvent supplied from the metering device over a predetermined time, a re-supply system for reloading the metering device of the known amount of liquid solvent; and a control system for controlling the operation of the workpiece holding device and the solvent dispensing system.

18 Claims, 4 Drawing Sheets

SOLVENT APPLICATION SYSTEM

BACKGROUND OF THE INVENTION

I. Field of the Invention

The present invention relates generally to the manufacture of propellant charge systems for large caliber artillery pieces, more particularly, to modular artillery charge systems or MACS, and involves improvements in a load, assembly and packaging process for manufacturing field modular charge units for singular and multi-unit propellant charge systems. Specifically, the invention is directed to an improved solvent application system and method which coordinates the sealing of the lid to the case of a MACS unit with precision.

II. Related Art

Propellant charges for cannon artillery systems, primarily large caliber weapons systems such as 155 mm howitzers, etc., typically include plurality of coordinating modular charge units serially loaded behind the shell. The individual modular charge units are generally cylindrical in shape, frequently having a length to diameter ratio approaching 1. A central axial opening is provided through each unit to facilitate ignition of that and consecutive units. Such a system concept is illustrated, for example, by Reinelt, et al., in U.S. Pat. No. 4,702,167.

Particular embodiments of such modular units are of a three-piece design, which includes a combustible case body, normally nitrocellulose, having a closed end provided with a central bore opening and an open end, a combustible cap or lid, provided with a central bore opening that aligns with that of the case body is adapted to fit or nest in and seal into the open end of the case body, and a combustible central or core tube, which fits over raised rims in the central bores of and connects the central openings provided in the closed ends of both the relatively rigid case body and lid to form a continuous central bore for containing core igniter bags. Top and bottom recesses are provided to accommodate two end igniter bags. This assures proper ignition of a number of serially placed modular charges. Up to eight modular charges may be employed in firing a 155 mm howitzer, for example.

The MACS load, assembly and packing process utilizes a series of discreet work stations, each of which is designed to accomplish a specific operation on the case, charge or additive materials. The present invention deals primarily with the provision of a significantly better approach to one difficult manual portion of the process including an operation at one discrete station in which the peripheral interface between the case and lid is sealed by the application of a volatile solvent such as acetone for the case and lid material.

This operation requires a specified, metered amount of solvent, normally acetone, to be applied evenly along the joint between the nitrocellulose case body and lid. Upon application, capillary action between the two rather tight fitting pieces draws the acetone along the mating surfaces and produces fusing of the two components together thereby sealing the module. The step further requires a positive shut-off from the solvent to prevent solvent spills and contact with the part other than at the juncture to be sealed. This step of the process has heretofore been accomplished entirely by a hand operation, the consistency of the results resting on the repetitive skill of the individual operator. The operator applied the acetone or other solvent using a hand-held syringe while, at the same time, spinning the module on a turn table. The operation of the table was also controlled by hand. This led to many peripheral inconsistencies in the form of over application and gaps in the application of the acetone, solvent and/or so to inconsistent sealing of the module. The syringe often would leak solvent onto the module rather than stopping abruptly at the end of the step. These drawbacks, in turn, could lead to rejection of the unit. This situation speaks of a definite need to improve this step of the process, to increase the accuracy of the sealing of the case and lid of each module, and also to remove the burden of consistency from the individual operator.

Accordingly, it is a primary object of the present invention to provide a system that automatically rotates and seals the case body and lid in a modular artillery charge system.

It is a further object of the present invention to provide such a fixture that is capable of consistently metering the exact desired amount of solvent and of insuring a complete solvent shut-off thereafter.

A still further object of the present invention is to provide such a system which interlocks the operation of the solvent dispensing with the rotation of the modular unit.

Another object of the present invention is the provision of a mechanized processing station that interlocks solvent dispensing with the provision of proper ventilation.

Still another object of the present invention is to provide a mechanized processing station that includes a mechanized turn table and adjacent solvent application device that assures complete and proper sealing of the module.

Additional objects and advantages regarding the invention will become apparent to those skilled in the art upon familiarization with the specification, drawings and claims contained herein.

SUMMARY OF THE INVENTION

The present invention solves many problems associated with the prior existing processes by providing automated mechanized discreet workstation system for precisely applying sealing solvent to the lid/body interface of a modular artillery charge system (MACS) unit or other workpiece. This system provides for case rotation and automated precise solvent quantity metering and shut off. Distribution (placement) about the periphery of the interface is also uniform as application is coordinated with turn table rotation.

The system is pneumatically-operated and includes a pneumatically driven turn table for mounting and rotating the modular unit to be sealed which is situated in precise relation to a solvent dispensing valve which applies the desired amount of solvent about the circular juncture between the cap and body as the modular unit is rotated. The solvent, normally acetone for a nitrocellulose cap and body, by capillary action is drawn into the joint to provide a complete welded or fused nitrocellulase seal.

The solvent dispensing system is contained on a mounting table beneath a ventilation hood and its operation is interlocked with a ventilation fan in the hood. The solvent dispensing system includes a solvent supply tank and a solvent supply dispensing valve which cooperates with a gas-tight measuring syringe connected also to a solvent dispensing valve. The solvent is precisely loaded and discharged by the operation of the measuring syringe. The syringe plunger is operated by a double acting hydraulic cylinder operated by a pair of air over metered fluid supply containers which cooperate with a follower arm-operated limit valve. A precise sequencing control system is also provided to coordinate proper sequencing of dispensing and refilling operations.

After a startup timing sequence, the operation is initiated by the operator utilizing a foot valve, or the like, and proceeds thereafter automatically to seal a modular unit placed in the turn table and then precisely reload the gas-tight measuring syringe for the next unit in a manner which is controlled by time-interlocked pneumatic valves and electric relays. Thus, the system and method of the invention for the precise patterned application of a liquid material upon a moving workpiece.

BRIEF DESCRIPTION OF THE DRAWINGS

In the drawings, wherein like numerals depict like parts throughout the same.

DETAILED DESCRIPTION

Figure 1:
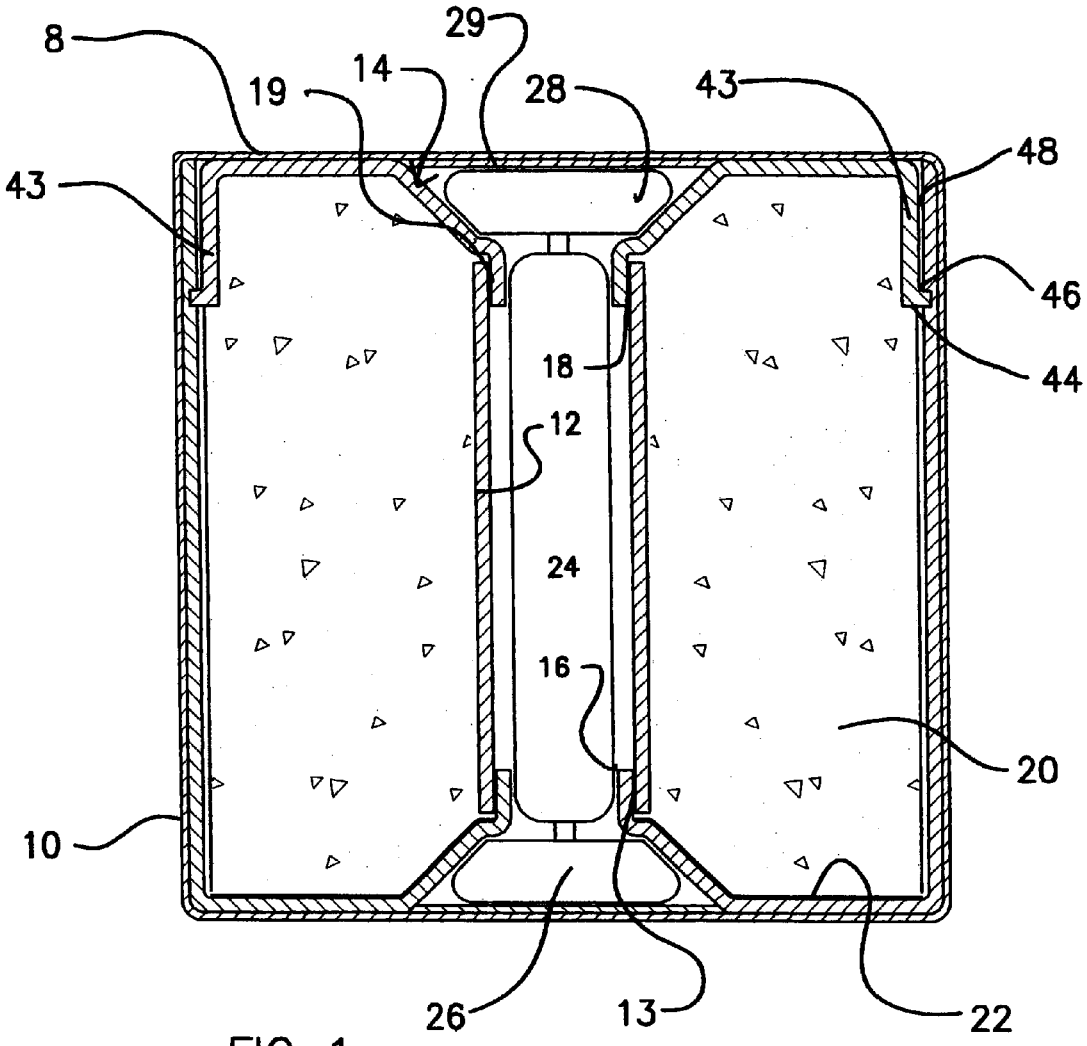
FIG. 1 is a cross section view of an individual propellant charge module of a class suitable to be sealed using the fixture of the system of the invention.
Figure 2:
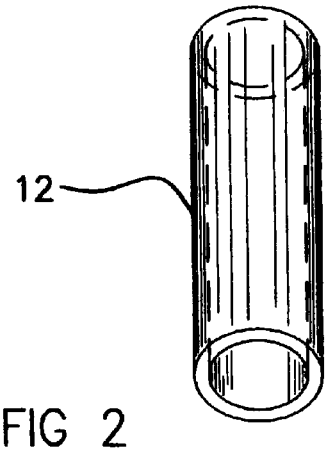
FIG. 2 is a perspective view of a center core tube in accordance with the charge module unit of FIG. 1.
Figure 3:
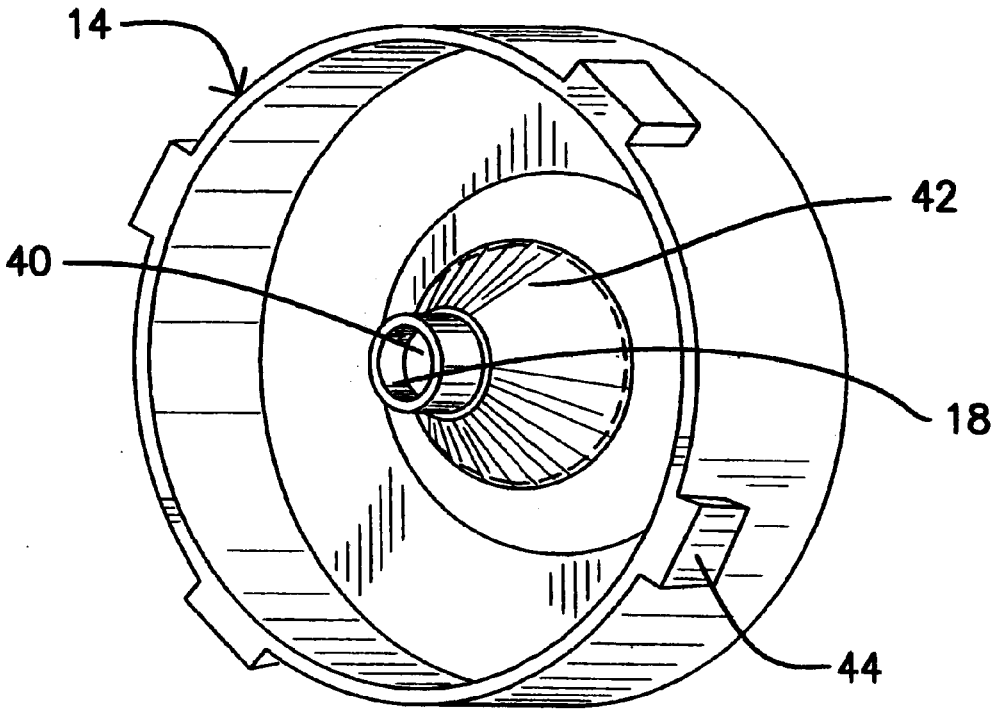
FIG. 3 is a perspective view of a lid to be sealed to case of the modular unit of FIG. 1.

FIGS. 1–3 depict a typical modular artillery charge system (MACS) charge unit, generally at 8, usable alone or serially with various numbers of other units in a plurality of propellant-loading configurations as a propellant charge for large cannons such as the 155 mm howitzer. It will occur to those skilled in the art that the system and method associated with the present invention are usable for processing a variety of these types of charges and other similar devices and that the unit of the detailed description is meant as an example and not by way of limitation.

The modular charge unit and elements depicted in FIGS. 1–3 is included herein as an illustrative example of a class of charge units which can be solvent sealed using the work station of the present invention. Additional details of such modular charge units are found in U.S. Pat. No. 5,747,723 issued to Gregory Buckalew et al., which is incorporated herein by reference in its entirety.

FIG. 1 shows a modular propellant charge unit including a unit body or shell 10, center core tube 12, and a cap 14 as the basic parts thereof. As can be seen from the figures, each of these is generally made up of a thin-walled hollow cylinder which, in the case of the center core tube 12, has two open ends. The body 10 and cap 14 each have an open end and a closed end. As seen in the figures, the open end of cap 14 fits into and seals the open end of the body 10 and the closed ends of both cap 14 and body 10 describe central openings with tubular rim or lip extensions.

The remaining portion of the body 10 is shown filled with a propellant material as at 20. The body, core and lid are generally made of combustible nitrocellulose coated with an environmentally stable protective coating shown about the periphery of FIG. 1 at 22. Typically, the body 10 and cap 14 each have a wall thickness between 2.0 mm and 2.7 mm. The dimensions and density of the body 10, core tube 12 and cap 14 must be within a very close tolerance to insure durability, critical functioning of the igniter and complete combustion. A core igniter bag 24 flanked by end igniter bags 26 and 28 is illustrated to make up the igniter system in FIG. 1. The make up and function of the igniter material is well known to those skilled in the art as is the composition of the main propellant charge and these details do not form a part of the present invention.

FIG. 2 depicts the center core tube or ignition tube 12 as a thin-walled cylinder with two open ends. The center core tube 12 typically has a wall thickness slightly less than that of the body 10 (typically 1.3–1.8 mm) may have a diameter of 17.7 mm to 31.8 mm. These dimensions are based on a 155 mm module and the devices have evolved and are designed in accordance with a large amount of accumulated interior ballistic knowledge or lore.

The center core tube 12 is positioned longitudinally in the body 10 and receives tubular extension 16 defining the center open portion of the body 10 and tubular extension 18 defining the center open portion of the cap 14 at 18 in the assembled modular unit. As can be seen in FIG. 3, the central portion of the cap 14 continues the hollow-center core ignition system through an opening 40 and includes a conical recessed section 42 and a tubular extension or raised rim 18 which is designed to be accommodated in one end of the center core tube 12. In this manner, the core tube 12 overlaps and seals the internal junctures with both the module case 10 by overlapping the rim or lip extension 16 at 13 and with the central opening in the cap by overlapping the rim 18 at 19. The outer rim of 43 of cap 14 further includes a series of protuberances or protrusions 44 spaced equally about the periphery of the open end of the cap and extending radially from the exterior surface. The protrusions 44 are designed to be accommodated or received in a groove 46 located in the body 10 (FIG. 1) so that the lid 14, when inserted, can be snapped into place. Once installed, a great deal of force is required to remove the lid from the modular body.

After the cap is inserted, however, there remains a peripheral gap 48 between the sidewall of the case 10 and the outer rim 43 of the cap 14. It is in this gap that a solvent, normally acetone for nitrocellulose units, is applied to the outer rim and by capillary action enters the gap 43 and peripherally fuses the lid rim 43 to the case body. Thereafter, the igniters 24, 26 and 28 can be added, together with the final weather proofing coat at 29.

Figure 4:
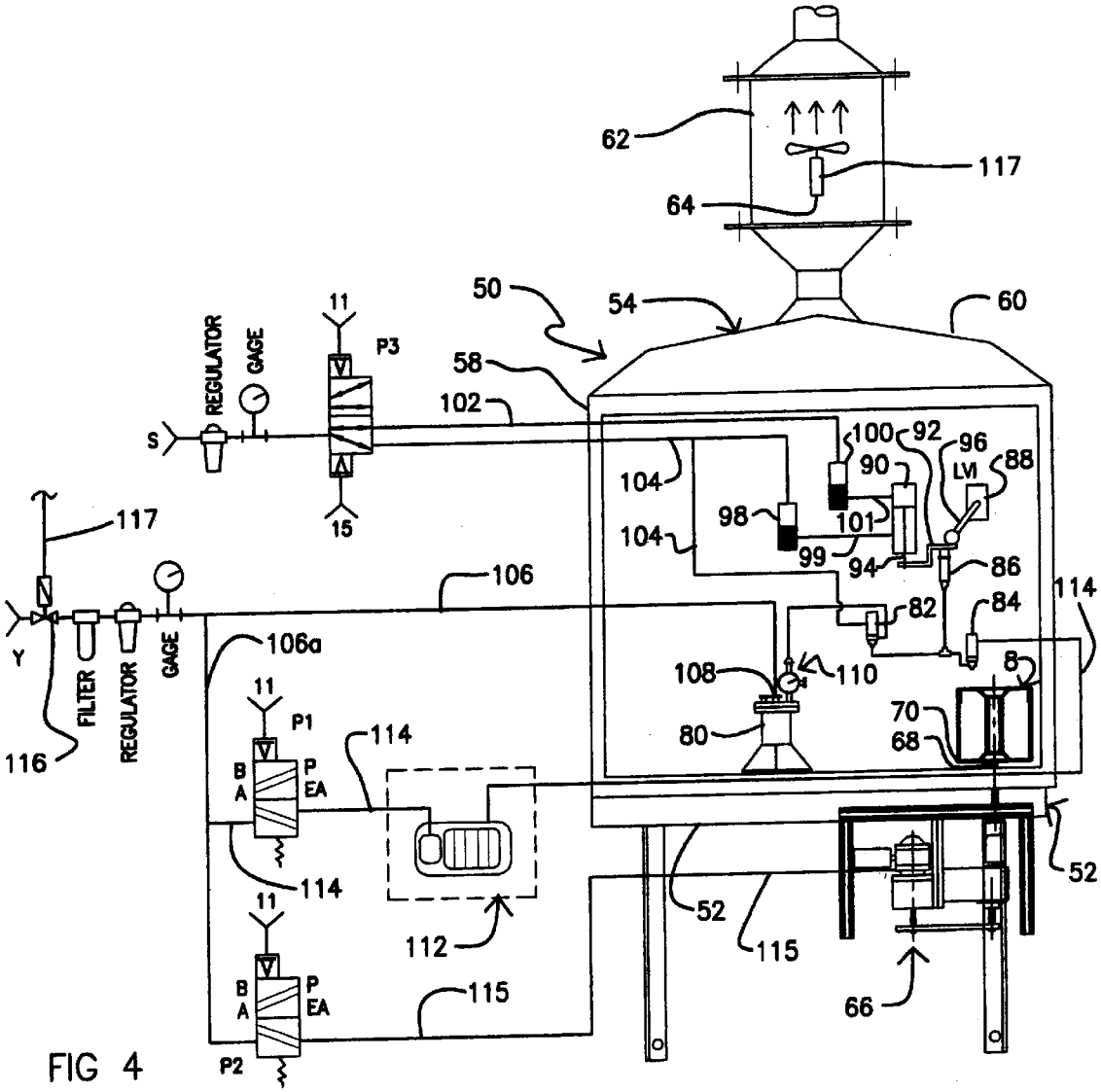
FIG. 4 is a schematic side elevational view of a work station for the application of sealing solvent in accordance with the present invention including pneumatic connections.

FIG. 4 depicts a schematic representation of a work station encompassing the mechanized sealing system in accordance with the invention. The system shown generally at 50 includes a bench or table 52 above which is mounted a molded ventilation hood 54. The hood is provided to deal with an open front, a rearwall 56, sidewalls 58 and a top member 60 which is, in turn, attached to a ventilation stack at 62 provided with an exhaust fan 64. The bench is provided with a turn table station indicated generally by 66 having a driven shaft 68 and a turn table deck 70 which is preferably pneumatically driven. A modular unit similar to that depicted in FIGS. 1–3 is pictured on the turn table and is preferably fixedly mounted on a locking spindle, or the like, attached to the turn table to precisely position the modular unit relative to the solvent applicator valve nozzle.

The solvent dispensing system is contained within the ventilation hood 54 and is designed for pneumatic operation. The system includes a solvent storage tank 80, a solvent supply dispensing valve 82 fixed in the desired spaced and postured relation to the turn table deck 70 as determined by the workpiece of interest to be processed and a dispensing valve 84. A gas-tight metric needle syringe is provided at 86 operated by a limit valve 88 and an air over double-acting cylinder 90 utilizing a shaped member 92 attached to the rod 94 of the double-acting cylinder 90 and a follower arm system 96 which operates the limit valve 88. Cylinder operating air over fluid supply containers are shown at 98 and 100 with metering orifices 99 and 101, respectively.

The air over fluid supplies 98 and 100, as metered by orifices 99 and 101, are operated pneumatically by a power valve P3 via pneumatic lines 102 and 104. Line 104 is also parallel connected to operate the supply nozzle 82 in refilling the metering syringe 86, as will be discussed.

The solvent tank is further provided with an air supply in line 106 via inlet 108. A solvent outlet with pressure gauge is shown at 110 to provide solvent to the supply nozzle 82 which, in turn, is metered to the dispensing valve 84 using the metering needle syringe 86. The dispensing operation is timed and controlled by a 7000 series or equivalent controller pictured at 112 in pneumatic line 114 in series with power valve P1. The turn table 66 is operated pneumatically using air supplied via line 115 as controlled by power valve P2. The dispensing valve and turn table are supplied from a common line 106A and parallel with line 106. A shut-off valve is provided at 116 and is further interlocked with the vent fan 64 via conductor 117 to prevent operation of this system without ventilation.

Figure 5:
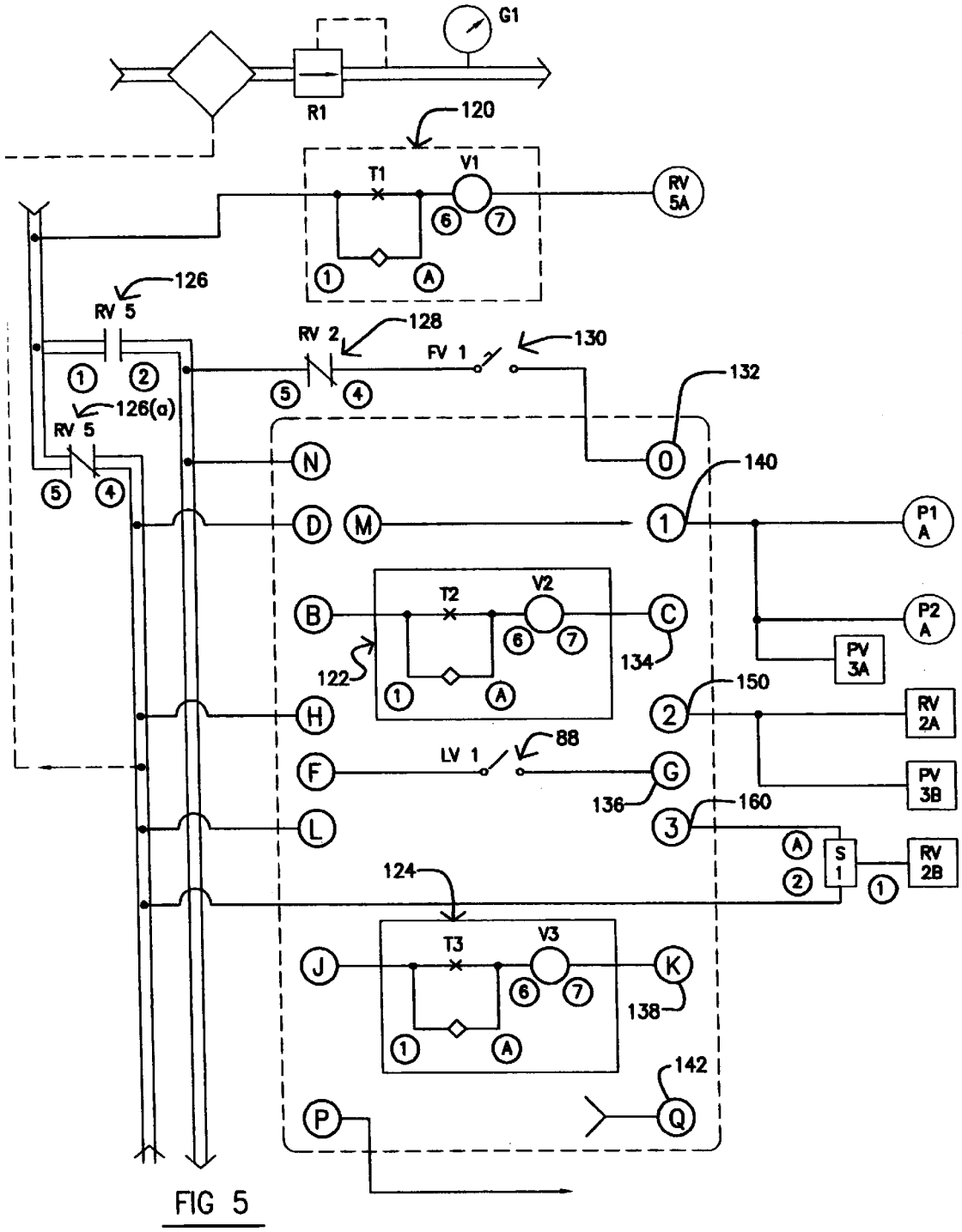
FIG. 5 is a schematic control diagram depicting a method operating the work station of FIG. 4.

The control system for the solvent sealing process step of the invention is pictured schematically in FIG. 5. The system includes time delay relays 120, 122 and 124, relay valve contacts 126, 126A and 128 and a foot valve 130, which controls sequenced events from start to finish in a module sealing cycle including a series of three events at 140, 150 and 160 via the main sequencing control module.

In operation, once the system is turned on, the timer of time delay relay 120 times out and establishes the enabling or starting point by initiating the switching of relay valve context 126 and 126A (opening context 126 and closing contacts 126). This provides power to the operator-controlled foot valve 130 via relay valve contact 128. By closing the foot valve 130, the operator initiates an automatic timed sequence of events which results in the solvent sealing of the module lid as will be discussed next.

The closing of foot valve 130 produces a signal at 132 which initiates event 140 by turning on P1, P2 and P3 introducing air into the system which starts the turn table rotating via P2 and line 115 at a predetermined speed. It also opens the dispensing valve 84 via P1 and timing controller 112 through line 114; and via P3 supplies air to line 102 to extend cylinder 90 and via 92 depress the plunger of needle syringe 86 to dispense a measured amount of solvent to dispensing valve 84. In this manner, as the module is rotated a known radial distance, usually about 2 revolutions a measured amount of solvent is uniformly applied through the dispensing valve 84 using the precise control of an air over oil cylinder system and the needle syringe 86.

During the solvent application, overall control timer 122 is timing out and thereafter this produces a signal at 134 which turns off everything in event 140. This provides a positive shutoff for the solvent to prevent overuse or spillage-long a problem in the manual step. Signal 134 also initiates event 150 by switching relay valve 2A thereby opening relay valve contacts 128 thereby dropping out foot valve 130 and switching valve P3 to initiate a pressurized refill sequence for he solvent dispenser. This pressurizes line 104 which also opens solvent supply dispensing valve 82 and retracts or collapses cylinder 90 via air over operator 98. This, in turn, raises the plunger and enables the precise refilling of the needle syringe 86 with another measured amount or dose of solvent. When the follower arm 96 reaches its upper limit indicating that the needle syringe is refilled to contain the desired volume of solvent, valve 88 closes producing a signal at 136 that turns off event 150 and initiates event 160. Timer at 124 turns on, contacts 128 are again closed and contacts 126 and 126A reset to their normal positions. Once timer 124 times out, a signal at 138 turns off event 160 at 142 thereby ending the cycle.

In one embodiment, the electronically controlled solvent dispenser valve 84 and needle syringe 86 cooperate to dispense 1.6 cc of solvent in a 12-second timed sequential step in which an air driven turntable system 66 is controlled at 10 rpm. The electronic dispensing valve 84 controls the rate of disposition of solvent and an electronic timer controls the duration of application rate and duration of application, of course, can be modified as desired.

This invention has been described herein in considerable detail in order to comply with the Patent Statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. A system for use in providing a peripheral seal between the case and lid of a MACS modular unit or other workpiece interface, the system comprising:

(a) a workpiece holding device for carrying and moving a workpiece of interest in relation to a solvent dispensing system;

(b) a solvent dispensing system for dispensing a known metered amount of solvent into the interface to be sealed on the workpiece, said solvent dispensing system further comprising;

(i) a metering device for dispensing a predetermined known amount of said solvent;

(ii) a stationary dispensing valve for dispensing solvent supplied from said metering device along said interface over a predetermined time;

(iii) a re-supply system for reloading said metering device with said known amount of liquid solvent; and (c) a control system for controlling the operation of said workpiece holding device and said solvent dispensing system.

2. A system as in claim 1 wherein said metering device further includes a mechanized syringe for receiving and dispensing a measured amount of solvent material, a limit valve and a double-acting cylinder for operating said syringe in conjunction with said limit valve.

3. The system as in claim 2 wherein said double-acting cylinder is a hydraulic cylinder operating in an air over oil mode.

4. The system as in claim 2 further comprising a source of solvent connected to a re-supply valve operated in conjunction with said double-acting cylinder to supply solvent for reloading said syringe.

5. The system as in claim 3 further comprising a source of solvent connected to a re-supply valve operated in conjunction with said double-acting cylinder to supply solvent for reloading said syringe.

6. The system as in claim 1 further comprising a ventilation hood for containing said system and interlock means preventing the operation of said system without ventilation.

7. The system as in claim 1 including a positive shut-off timing controller associated with said stationary dispensing valve for providing positive shut off for said valve.

8. The system as in claim 1 wherein said control system automatically operates said workpiece holding device and said solvent dispensing system in an automatic sequence of sealing steps.

9. The system as in claim 1 wherein said control system further comprises an enabling timing circuit in conjunction with an electrically energized and interlocked manually operated valve to enable the operator to initialize an automatic sealing sequence.

10. A solvent sealing system for sealing the circular peripheral interface between the case and cap of a MACS modular unit, the system comprising:

(a) a turn table for carrying and rotating said modular unit in relation to a solvent dispensing system;

(b) a solvent dispensing system for dispensing a known metered amount of solvent along said circular interface, said solvent dispensing system further comprising:

(i) a metering device for carrying and dispensing a predetermined known amount of said solvent;

(ii) a stationary dispensing valve for dispensing solvent supplied from said metering device along said interface over a predetermined time, (iii) a supply system for reloading said metering device with said known amount of liquid solvent;

(c) a control system for controlling the operation of said turn table and said solvent dispensing system.

11. A system according to claim 10 wherein said metering device further includes a mechanized syringe for receiving and dispensing a measured amount of solvent material and a double-acting cylinder for operating said syringe in conjunction with a limit valve.

12. The system as in claim 11 wherein said double-acting cylinder is a hydraulic cylinder operating in an air over oil mode.

13. The system as in claim 12 further comprising a source of solvent and a re-supply valve operated in conjunction with said double-acting cylinder to supply solvent for reloading said syringe.

14. The system as in claim 10 further comprising a ventilation hood for containing said system and interlock means preventing the operation of said system without ventilation.

15. The system as in claim 10 including a positive shut-off timing controller associated with said stationary dispensing valve for providing positive shut off for said valve.

16. The system according to claim 10 wherein said control system further comprises an enabling timing circuit in conjunction with an electrically energized and interlocked manually operated foot valve to enable the operator to initialize an automatic sealing sequence.

17. A method of sealing the case and lid of a MACS modular unit or an interface of another workpiece, the method comprising the steps of:

(a) providing a mechanized holding device and a solvent dispensing system for dispensing a known metered amount of solvent along said circular interface, said solvent dispensing system further comprising:

(i) a metering device for carrying and dispensing a predetermined known amount of said solvent;

(ii) a stationary dispensing valve for dispensing solvent supplied from said metering device along said interface over a predetermined time, (iii) a supply system for reloading said metering device with said known amount of liquid solvent;

(b) placing the workpiece on said holding device for carrying and moving the workpiece in relation to said solvent dispensing system, said workpiece holding device and said solvent dispensing system being located within a ventilation hood;

(c) providing an automatic control system for controlling the operation of said holding device and said solvent dispensing system;

(d) initiating the operation of said sealing sequence by manually operating a valve and enabled by said control system to initiate the solvent sealing sequence;

(e) initiating the moving of said workpiece by said holding device;

(f) causing said metering device to supply solvent and said dispensing valve to dispense said solvent along said interface;

(g) shutting off said dispensing valve after a predetermined time and shutting off said holding device;

(h) re-supplying said metering device with a new predetermined known amount of said solvent; and (i) initializing said system for processing the next unit.

18. The method of claim 17 wherein said metering device is a mechanized syringe and further comprising the step of operating said syringe with a double-acting air over oil cylinder in both the dispensing and re-supplying steps.

* * * * *